US008449276B2

(12) United States Patent
Bodart et al.

(10) Patent No.: US 8,449,276 B2
(45) Date of Patent: May 28, 2013

(54) VARIABLE-SPEED SCROLL-TYPE REFRIGERATION COMPRESSOR

(75) Inventors: Jean-Paul Bodart, Chazay d'Azergues (FR); Yves Rosson, Villars les Dombes (FR)

(73) Assignee: Danfoss Commercial Compressors, Trevoux (FR)

( * ) Notice: Subject to any disclaimer, the term of this patent is extended or adjusted under 35 U.S.C. 154(b) by 786 days.

(21) Appl. No.: 12/450,434

(22) PCT Filed: May 23, 2008

(86) PCT No.: PCT/FR2008/050891

§ 371 (c)(1), (2), (4) Date: Nov. 12, 2009

(87) PCT Pub. No.: WO2008/152280

PCT Pub. Date: Dec. 18, 2008

(65) Prior Publication Data

US 2010/0098570 A1 Apr. 22, 2010

(30) Foreign Application Priority Data

May 29, 2007 (FR) ..... 07 03782

(51) Int. Cl.
*F04C 15/00* (2006.01)
*F04C 2/00* (2006.01)

(52) U.S. Cl.
USPC ..... 418/87; 418/55.1; 418/55.6; 418/94; 418/270; 418/DIG. 1

(58) Field of Classification Search
USPC ..... 418/55.1–55.6, 57, 94, 270, DIG. 1, 418/87–88, 102; 417/310, 410.1, 902
See application file for complete search history.

(56) References Cited

U.S. PATENT DOCUMENTS

| | | | | |
|---|---|---|---|---|
| 4,563,138 | A * | 1/1986 | Hofmann et al. | 418/97 |
| 6,322,339 | B1 | 11/2001 | Mitsunaga et al. | |
| 6,350,111 | B1 * | 2/2002 | Perevozchikov et al. | 418/55.6 |
| 2006/0257273 | A1 * | 11/2006 | Ignatiev | 418/55.1 |

FOREIGN PATENT DOCUMENTS

| | | | | |
|---|---|---|---|---|
| FR | 2 885 966 | | 11/2006 | |
| JP | 62178791 | A * | 8/1987 | |
| JP | 01063694 | A * | 3/1989 | 418/55.6 |
| JP | A-4-17793 | | 1/1992 | |

(Continued)

OTHER PUBLICATIONS

International Search Report for Application No. PCT/FR2008/050891, issued Aug. 3, 2009.

*Primary Examiner* — Theresa Trieu
(74) *Attorney, Agent, or Firm* — Oliff & Berridge, PLC

(57) ABSTRACT

The compressor includes a sealed housing defining a suction volume and a compression volume respectively provided on either side of a body contained in the housing, an oil injection circuit supplied with oil from an oil contained in a casing and adapted for injecting oil into the compression volume, the oil injection circuit comprising an electrovalve including a body attached to the wall of the sealed housing and a core movable under the action of a magnetic fluid between a closing position for injecting oil into the compression volume and an opening position preventing or limiting the injection of oil into the compression volume. The compressor includes a control system for moving the core of the electrovalve between the opening and closing positions based on the compressor speed and/or on the cooling gas discharge temperature.

18 Claims, 6 Drawing Sheets

FOREIGN PATENT DOCUMENTS

| | | |
|---|---|---|
| JP | A-6-185479 | 7/1994 |
| JP | A-8-42469 | 2/1996 |
| JP | A-2000-283070 | 10/2000 |
| JP | A-2002-349461 | 12/2002 |

* cited by examiner 14
7
3
36
37
5
MC
9
32
16
15
31
2
26b
30
19
25
29
26a
27
28
4
21
22

VARIABLE-SPEED SCROLL-TYPE REFRIGERATION COMPRESSOR

BACKGROUND OF THE INVENTION

The present invention relates to a variable-speed scroll-type refrigeration compressor.

DESCRIPTION OF THE PRIOR ART

Document FR 2 885 966 describes a scroll compressor, also known as a scroll pump, comprising a sealed enclosure defined by a barrel defining a suction volume and a compression volume, one on either side of a body contained within the enclosure. The barrel defining the sealed enclosure comprises a refrigerant gas inlet.

An electric motor is located inside the sealed enclosure, with a stator on the outside, fixed relative to the barrel, and a rotor in a central position connected to a crankshaft-like drive shaft which has a first end driving an oil pump supplying oil from a sump in the bottom of the enclosure to a lubrication way in the center of the shaft. The lubrication way comprises lubrication ports for each guide bearing of the drive shaft.

The compression volume contains a compression stage comprising a fixed volute fitted with a scroll engaged in a scroll on a moving volute, the two scrolls defining at least one compression chamber of variable volume. The second end of the drive shaft is fitted with an eccentric which drives the moving volute in an orbital movement to compress the aspirated refrigerant gas.

From a practical point of view, the refrigerant gas arrives from the outside and enters the sealed enclosure. Some of the gas is drawn directly into the compression volume, while the rest of the gas passes through the motor before being drawn into the compression stage. All of the gas reaching the compression stage, either directly or first passing through the motor, is drawn by the compression stage into at least one compression chamber defined by the two scrolls, entering at the edge of the compression stage, and as the gas is carried towards the center of the scrolls it is compressed by the diminishing volume of the compression chambers due to the movement of the moving volute relative to the fixed volute. The compressed gas passes out from the center part into the compressed-gas receiving chamber.

Depending on the internal flow configuration of this type of compressor, the refrigerant gas entering the compressor can entrain oil, the oil coming from, for example, leaks from bearings or from the gas licking up the surface of the oil in the sump.

It should be observed that the proportion of oil in the refrigerant gas varies depending on the speed of rotation of the rotor of the electric motor.

Thus, when the rotor is turning slowly, the amount of oil circulating with the refrigerant gas is low, which can lower the performance of the compressor and reduces the lubrication of its various parts.

On the other hand, when the rotor is turning fast, the proportion of oil in the refrigerant gas leaving the compressor can become excessive. The direct consequence of this excessive proportion of oil in the gas is less efficient heat exchange by the exchangers situated downstream of the compressor. This is because the oil droplets contained in the gas tend to become deposited on the heat exchangers and form a layer of oil on them.

In addition, an excessive proportion of oil in the gas can also drain the oil sump. This could lead to destruction of the compressor.

Document U.S. Pat. No. 6,322,339 describes a way of improving the low-speed performance of a variable-speed compressor without harming its efficiency at high speed. The approach is to increase the amount of oil introduced into the gas stream at low speeds only.

Document U.S. Pat. No. 6,322,339 thus describes a variable-speed scroll-type refrigeration compressor comprising an oil injection line supplied with oil from oil contained in a sump in the bottom of the enclosure, the injection line being designed to inject oil into the compression volume.

The oil injection line comprises a valve housed in the sealed enclosure and movable between an open position allowing oil to be injected into the compression volume, and a closed position preventing the injection of oil into the compression volume, the valve being subjected to the action of a compression spring that tends to keep it in its open position.

The compression spring is designed to keep the valve in its open position as long as the pressure difference between the two sides of the valve is less than or equal to the spring's elasticity. As soon as this pressure difference becomes greater than the elasticity of the spring, the valve is moved to its closed position, preventing oil being injected into the compression volume.

It should be observed that the elasticity of the spring requires calibration to allow the valve to be moved to its open position as soon as the speed of rotation of the drive shaft falls below a predetermined value, and to its closed position as soon as the speed of rotation of the drive shaft rises above a predetermined value.

This sort of oil injection line has disadvantages as outlined below.

This calibration of the elasticity of the compression spring acting on the valve is complex and cannot be performed accurately. As a result, the means employed in document U.S. Pat. No. 6,322,339 are complex and cannot be used to accurately control the injection of oil into the compression volume.

Furthermore, the elasticity of the compression spring can vary over time. The means used in document U.S. Pat. No. 6,322,339 do not therefore keep the performance of the compressor constant.

Another disadvantage with this type of oil injection line is the fact that particles can insinuate themselves between the walls of the housing in which the valve slides, and the valve itself. These particles can interfere with the operation of the valve and therefore with that of the oil injection line.

In addition, locating the valve inside the barrel means that the valve is difficult to maintain. In particular, it is difficult to replace the compression spring or clean out the housing in which the valve slides.

Document JP 06 185479 describes a more accurate means of controlling the injection of oil into the compression volume.

Document JP 06 185479 describes a variable-speed scroll-type refrigeration compressor comprising an oil injection line supplied with oil from oil contained in a sump in the bottom of the enclosure and designed to inject oil into the compression volume, the oil injection line comprising a solenoid valve having a core that can be made to move by, a magnetic field, between a first position allowing oil to be injected into the compression volume and a second position preventing or limiting the injection of oil into the compression volume. The solenoid valve is on the outside of the sealed jacket of the compressor and comprises an oil inlet port supplied with oil by a supply pipe extending partly out of the sealed enclosure and connected to an outlet port of an oil pump located inside the oil sump, and an oil outlet port connected to an injection pipe extending partly outside of the sealed enclosure and leading into the compression volume.

The refrigeration compressor also comprises control means designed to move the solenoid valve core between its first and second positions.

The presence of the solenoid valve in the oil injection line gives more precise control over the injection of oil into the compression volume, because the calibration to a given value of the magnetic field which is intended to move the solenoid valve core can be performed accurately via control means.

However, the arrangement of the supply and injection pipes, which are at least partly outside of the sealed jacket, can lead to rupturing of the pipes as a result of unforeseen impacts or stresses during maintenance of the compressor.

This arrangement of the supply and injection pipes also necessitates creating openings in the sealed jacket of the compressor for the pipes to pass through. Creating such openings can allow leaks of refrigerant fluids into the atmosphere and therefore increase greenhouse gas emissions.

The purpose of the present invention is to solve these problems by providing a variable-speed scroll-type refrigeration compressor that is structurally simple and allows easy maintenance of the oil injection line, while allowing precise control over the injection of oil into the compression volume, reducing greenhouse gas emissions, and enhancing the protection of the compressor against external impacts and stresses.

SUMMARY OF THE INVENTION

To this end, the present invention relates to a variable-speed scroll-type refrigeration compressor comprising:

- a sealed enclosure defining a suction volume and a compression volume, one on either side of a body contained within the enclosure, the enclosure comprising a refrigerant gas inlet,
- an oil injection line supplied with oil from oil contained in a sump in the bottom of the enclosure and designed to inject oil into the compression volume, the oil injection line comprising a solenoid valve having a core that can be made to move by a magnetic field, between a first position allowing oil to be injected into the compression volume and a second position preventing or limiting the injection of oil into the compression volume, and
- control means for moving the solenoid valve core between its first and second positions, said compressor being characterized in that the solenoid valve has a body attached to the wall of the sealed enclosure and containing the core, and in that the control means are designed to move the solenoid valve core between its first and second positions, in response to the compressor speed and/or the refrigerant gas delivery temperature.

The attachment of the solenoid valve to the wall of the sealed enclosure allows easy maintenance of the solenoid valve because the latter is easily accessible from the outside of the compressor.

Moreover, this attachment of the solenoid valve to the wall of the sealed enclosure avoids the creation of openings in the sealed jacket for the passage of the supply and injection pipes, and avoids having at least some of these pipes on the outside of the sealed jacket. This enhances the protection of the injection pipe and hence of the compressor against external impacts and stresses and reduces greenhouse gas emissions.

Advantageously, the body of the solenoid valve comprises a first body portion attached to the wall of the enclosure and a second body portion attached removably to the first body portion, outside of the sealed enclosure, the second body portion containing the solenoid valve core. This structure of the solenoid valve body further facilitates the maintenance of this solenoid valve.

The control means are preferably designed to move the solenoid valve core to its first position when the compressor speed is below a predetermined value or when the refrigerant gas delivery temperature is above a predetermined value.

In another embodiment of the invention, the control means are designed to move the solenoid valve core to its first position when the refrigerant gas delivery temperature is above a predetermined value and the compressor speed is below a predetermined value.

In accordance with another feature of the invention, the control means are designed to move the solenoid valve core to its second position when the compressor speed is above a predetermined value.

In accordance with yet another feature of the invention, the compressor comprises an electric motor having a stator and, integral with a crankshaft-like drive shaft, a rotor, a first end of which drives an oil pump supplying oil from the sump in the bottom of the enclosure to a way formed in the central part of the shaft, said compressor being characterized in that the oil injection line is supplied with oil by the oil pump which is driven by the first end of the drive shaft.

The solenoid valve advantageously comprises at least one oil inlet port supplied with oil by a supply pipe located inside the sealed enclosure and connected to an outlet port of the oil pump which is driven by the first end of the drive shaft, a first oil outlet port opening inside the sealed enclosure, and a second oil outlet port connected to at least one injection pipe located inside the sealed enclosure and opening into the compression volume. The pipes are advantageously subjected to small pressure differentials (that is, less than 3 bar) compared with the pressure in the low-pressure enclosure of the compressor (around 5 to 20 bar). This means that low-pressure pipe can be used.

The solenoid valve core is preferably movable, by a magnetic field, between a closed position of the first oil outlet port in which all the oil entering the solenoid valve through the oil inlet port is directed to the second oil outlet port, and an open position of the first oil outlet port in which all or nearly all the oil entering the solenoid valve through the oil inlet port is directed to the first oil outlet port.

Thus, whatever position the solenoid valve core is in, all of the oil arriving from the oil pump and entering the solenoid valve is redirected into the sealed enclosure and/or into the compression volume. With these arrangements the invention avoids increasing the delivery pressure of the oil pump, which would use more energy.

In another embodiment of the invention, the solenoid valve comprises an annular chamber connecting together the inlet and outlet ports of the solenoid valve.

The head losses in the second oil outlet port and in the injection pipe are advantageously much greater than those in the first oil outlet port.

In yet another embodiment of the invention, the solenoid valve comprises a pipe connecting the second oil outlet port to a connection port formed in the solenoid valve and leading into a bore formed in the solenoid valve and containing the core of the latter, the bore being connected to a chamber which in turn is connected to the oil inlet port and the first oil outlet port, and in that the core is designed to close the connection port when it is in its open position.

The injection pipe preferably comprises an injection nozzle at that end of the pipe which opens into the compression volume.

In accordance with another feature of the invention, the end of the injection pipe that opens into the compression volume is inserted into a through-bore formed inside the body separating the compression and suction volumes.

A pin is advantageously inserted in the end of the injection pipe that leads into the compression volume in such a way as to compress the injection pipe against the walls of the bore formed inside the body, the pin comprising an injection passage allowing oil to be injected into the compression volume. The pin is preferably a roll pin or a coiled pin.

In accordance with another feature of the invention, the compression volume comprises a fixed volute fitted with a scroll engaged in a scroll of a moving volute driven with an orbital movement, the moving volute bearing against the body separating the compression and suction volumes.

That end of the bore formed in the body which is directed towards the moving volute preferably comes to an open end outside of the area swept by the moving volute during its orbital movement.

Alternatively, that end of the bore formed in the body which is directed towards the moving volute comes to an open end within the area swept by the moving volute during its orbital movement.

Advantageously, the moving volute comprises at least one through-port designed to connect, during at least part of the movement of the moving volute, the end of the injection pipe that opens into the compression volume to a volume defined at least partly by the fixed and moving volutes.

However, the invention will be understood clearly with the help of the following description, referring to the labeled schematic drawing showing, as non-restrictive examples, a number of embodiments of this scroll compressor.

DESCRIPTION OF THE PREFERRED EMBODIMENTS

In the following description, the same parts are given the same reference signs in the different embodiments.

Figure 1:
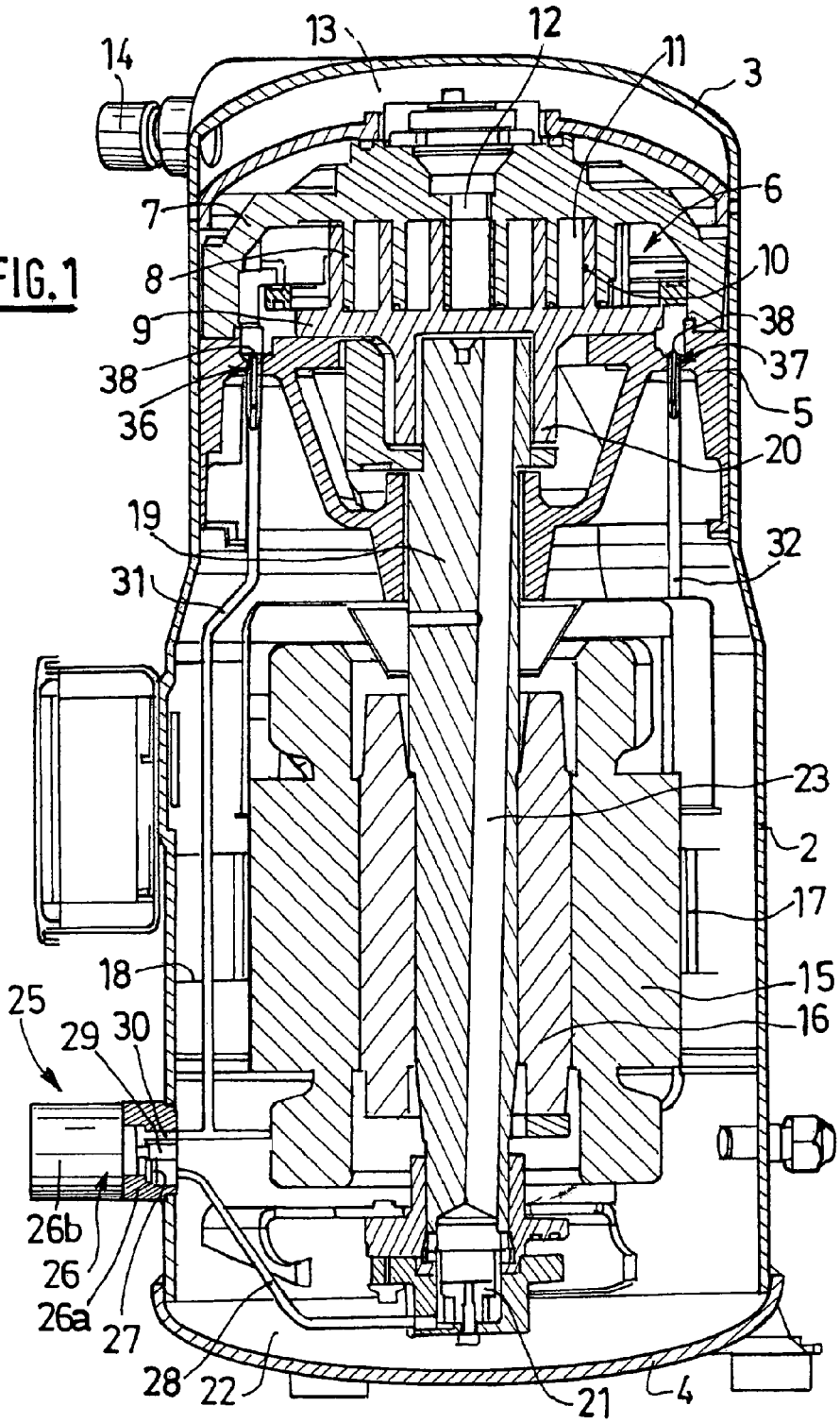
FIG. 1 is a longitudinal section through a first compressor.

FIG. 1 shows a variable-speed scroll-type sealed refrigeration compressor occupying a vertical position. However, the compressor according to the invention could occupy an inclined position, or a horizontal position, without significant modification to its structure.

The compressor shown in FIG. 1 comprises a sealed enclosure defined by a barrel 2 whose top and bottom ends are closed by a cap 3 and a base 4 respectively. Weld seams may for example be used to assemble this enclosure.

The intermediate part of the compressor is occupied by a body 5 that defines two volumes, a suction volume situated beneath the body 5, and a compression volume located above the latter. The barrel 2 comprises a refrigerant gas inlet leading into the suction volume to bring the gas to the compressor.

The body 5 serves as a mounting for the refrigerant gas compression stage 6. This compression stage 6 comprises a fixed volute 7 fitted with a fixed scroll 8 which faces downwards, and a moving volute 9 bearing against the body 5 and fitted with a scroll 10 which faces upwards. The two scrolls 8 and 10 of the two volutes fit one inside the other to create compression chambers of variable volume. Gas is admitted into the compression stage from the outside, the compression chambers 11 having a variable volume which decreases from the outside towards the interior, when the moving volute 9 moves relative to the fixed volute 7. The compressed gas escapes from the centre of the volutes through an opening 12 in the fixed volute 7 leading to a high-pressure chamber 13, from which it is discharged by a connector 14.

The compressor comprises an electric motor situated inside the suction volume. The speed of the electric motor can be varied by means of a variable-frequency electric generator.

The electric motor comprises a stator 15 with a rotor 16 in its center. The motor is attached to the barrel 2 by a collar 17 passing around the stator 15 and connected by tabs 18 to the barrel 2.

The rotor 16 is connected to a drive shaft 19 with its top end off-center in the manner of a crankshaft. This top end is engaged in a sleeve part 20 of the moving volute 9. When turned by the motor, the drive shaft 19 drives the moving volute 9 in an orbital movement.

The bottom end of the drive shaft 19 drives an oil pump 21 which supplies oil from a sump 22 defined by the base 4 to a lubrication way 23 formed inside the central part of the drive shaft.

The scroll compressor also comprises an oil injection line supplied with oil by the oil pump 21 driven by the bottom end of the drive shaft 19. The oil injection line is designed to inject oil into the compression volume, and more particularly between the fixed 7 and moving 9 volutes.

The oil injection line comprises a solenoid valve 25 comprising a body 26 attached to the wall of the barrel 2 near the base 4.

Figure 3:
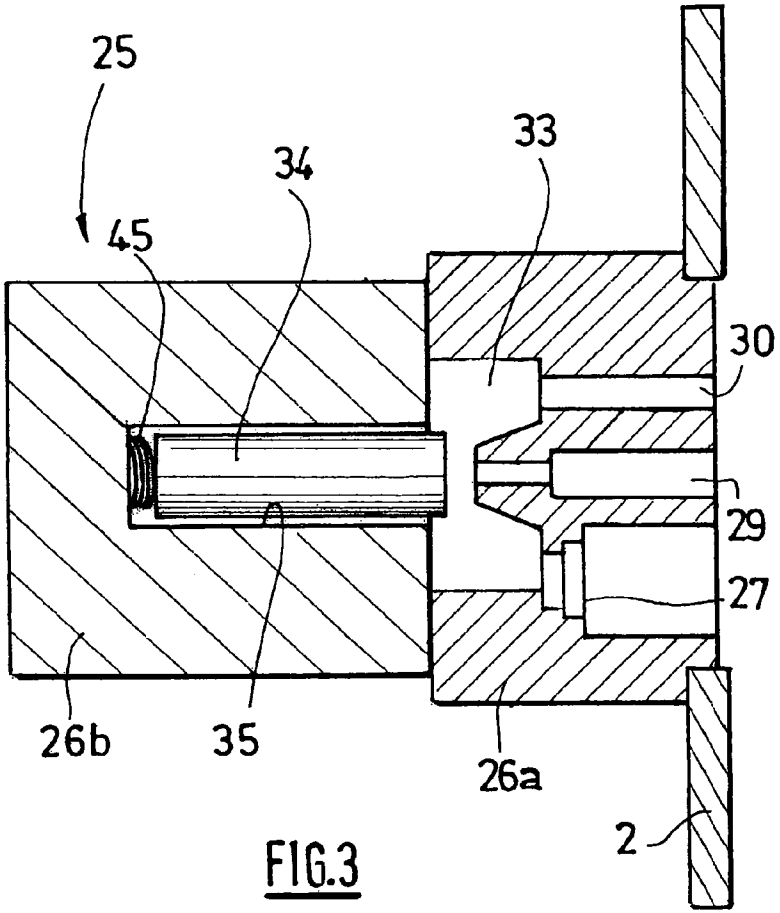
FIGS. 2 and 3 are enlarged sections through a solenoid valve in a first embodiment of the invention in which the valve is shown in its closed and open positions, respectively.
Figure 2:
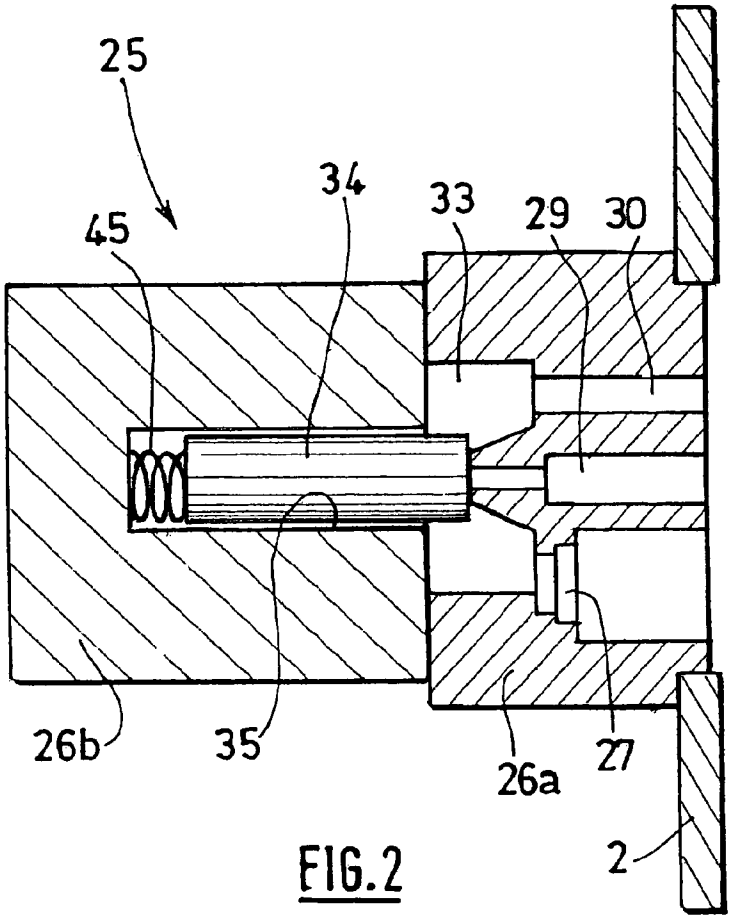

As shown more particularly in FIGS. 2 and 3, the body of the solenoid valve 25 comprises a first body portion **26*a* attached to the wall of the barrel 2 and a second body portion 26*b* attached removably to the first body portion 26*a* outside of the barrel 2**.

The solenoid valve 25 comprises an oil inlet port 27 supplied with oil by a supply pipe 28 arranged inside the barrel and connected to an outlet port of the oil pump 21. The solenoid valve also comprises a first oil outlet port 29 opening into the barrel 2 and a second oil outlet port 30 connected to first and second injection pipes 31, 32 located inside the barrel and each leading into the compression volume. The oil inlet and outlet ports are formed in the first body portion **26*a* and lead into an annular chamber 33 formed in the first body portion 26*a*. This annular chamber 33** allows the oil inlet and outlet ports of the solenoid valve to be connected to each other.

The solenoid valve comprises a metal core 34 housed in a bore 35 formed in the second body portion **26*b* and movable by a magnetic field, generated by a coil (not shown in the figures) surrounding the core 34**, between a closed position allowing oil to be injected into the compression volume, and an open position which prevents or limits the injection of oil into the compression volume.

More specifically, the core 34 of the solenoid valve is movable between a closed position of the first oil outlet port 29 shown in FIG. 2, in which all the oil entering the solenoid valve via the oil inlet port 27 is directed to the second oil outlet orifice 30 via the annular chamber 33, and an open position of the first oil outlet port 29 shown in FIG. 3 in which all or nearly all the oil entering the solenoid valve through the oil inlet port 27 is directed to the first oil outlet port 29.

When the core is in its open position, all or nearly all the oil entering the solenoid valve is directed to the first oil outlet port 29 because the head losses in the second oil outlet port 30 and in the first and second injection pipes 31, 32 are much greater than those in the first oil outlet port 29.

It should be pointed out that the core 34 of the solenoid valve 25 is also subjected to the action of a compression spring 45 housed between the bottom of the bore 35 and the core 34. This compression spring helps to move the core 34 to its closed position.

It should be observed that the ends of the first and second injection pipes 31, 32 leading into the compression volume are inserted into through-bores 36, 37, respectively, formed in the body 5 separating the compression and suction volumes. The bores 36, 37 are approximately parallel to the compressor axis.

As shown in FIG. 1, the open ends of the bores 36, 37 directed towards the moving volute 9 are outside of the surface swept by the latter in its orbital movement. In another embodiment, either or both of the open ends of the bores 36, 37 directed towards the moving volute may be within the surface swept by the latter.

The first and second injection pipes 31, 32 each comprise an injection nozzle at their end directed into the compression volume.

Each injection nozzle takes the form of a pin 38 inserted in the end of the corresponding injection pipe 31, 32 directed towards the body 5. This arrangement of the pins 38 allows the first and second injection pipes 31, 32 to be compressed against the walls of the corresponding bores 36, 37, respectively. The result is that the first and second injection pipes 31, 32 are held firmly in the body 5.

Each pin 38 comprises an injection passage allowing oil to be injected into the compression volume. The pins 38 are advantageously roll pins or coiled pins.

The compressor comprises control means for moving the core 34 of the solenoid valve 25 to its closed position when the speed of the compressor is less than a predetermined threshold value and moving the core of the solenoid valve to its open position when the speed of the compressor is above this predetermined value.

The control means are more particularly constructed to modify the magnetic field generated by the coil of the solenoid valve in response to the speed of the electric motor of the compressor in such a way as to allow the core 34 to move between its open and closed positions as the speed of the motor either exceeds or falls below, the predetermined value.

The operation of the scroll compressor will now be described.

When the scroll compressor according to the invention is started, the rotor 16 turns the drive shaft 19 and the oil pump 21 pumps oil from the sump 22 into the supply pipe 28. The oil then enters the oil inlet port 27 of the solenoid valve 25. As long as the speed of the compressor is below the predetermined threshold value, the core 34 of the solenoid valve is in its closed position, and oil that has entered the solenoid valve is therefore directed to the second oil outlet port 30 via the annular chamber 33, and thence into the first and second injection pipes 31, 32. The oil is finally injected into the compression volume through the injection nozzles.

It should be observed that the end of the bore 37 directed towards the moving volute 9 can be closed by the latter for at least part of the orbital movement of the moving volute. This closing off of the end of the bore 37 directed towards the moving volute 9 not only lubricates the interface between the body 5 and the moving volute, but also regulates the amount of oil injected into the compression volume.

When the speed of the compressor exceeds the predetermined value, the control means move the core 34 of the solenoid valve to its open position. As a result, all or nearly all the oil entering the solenoid valve through the oil inlet port 27 is directed to the first oil outlet port 29, because head losses in the second oil outlet orifice 30 and in the first and second injection pipes 31, 32 are much greater than those in the first oil outlet port 29. As a result, all or nearly all the oil that has entered the solenoid valve falls by gravity into the oil sump 22.

The compressor according to the invention allows the amount of oil present in the compression volume, and therefore the proportion of oil in the refrigerant gas to be increased only when the speed of the compressor is low and below the predetermined threshold value. The present invention improves the low-speed performance of the variable-speed compressor without reducing its efficiency at high speed.

Figure 4:
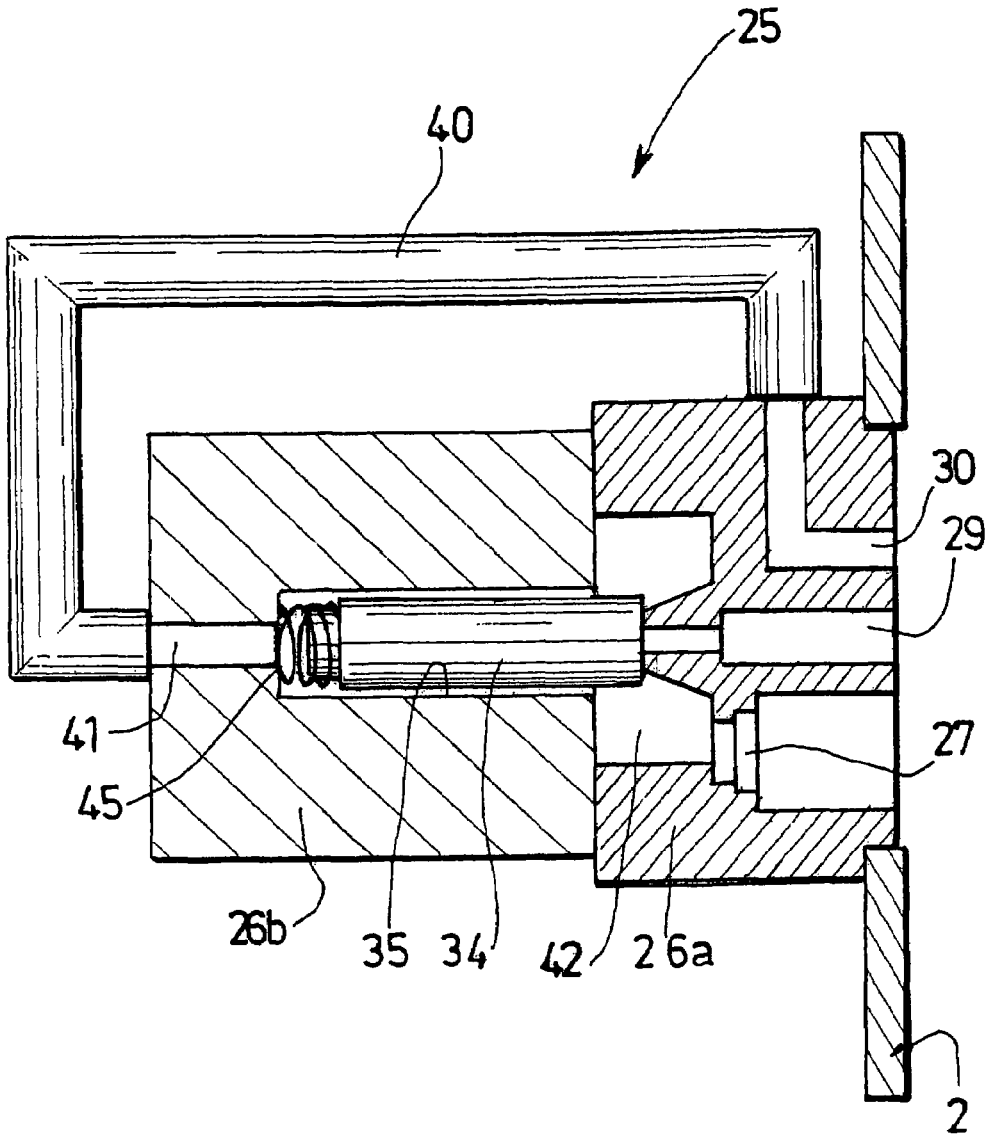
FIGS. 4 and 5 are enlarged sections through a solenoid valve in a second embodiment of the invention, showing the valve in its closed and open positions, respectively.
Figure 5:
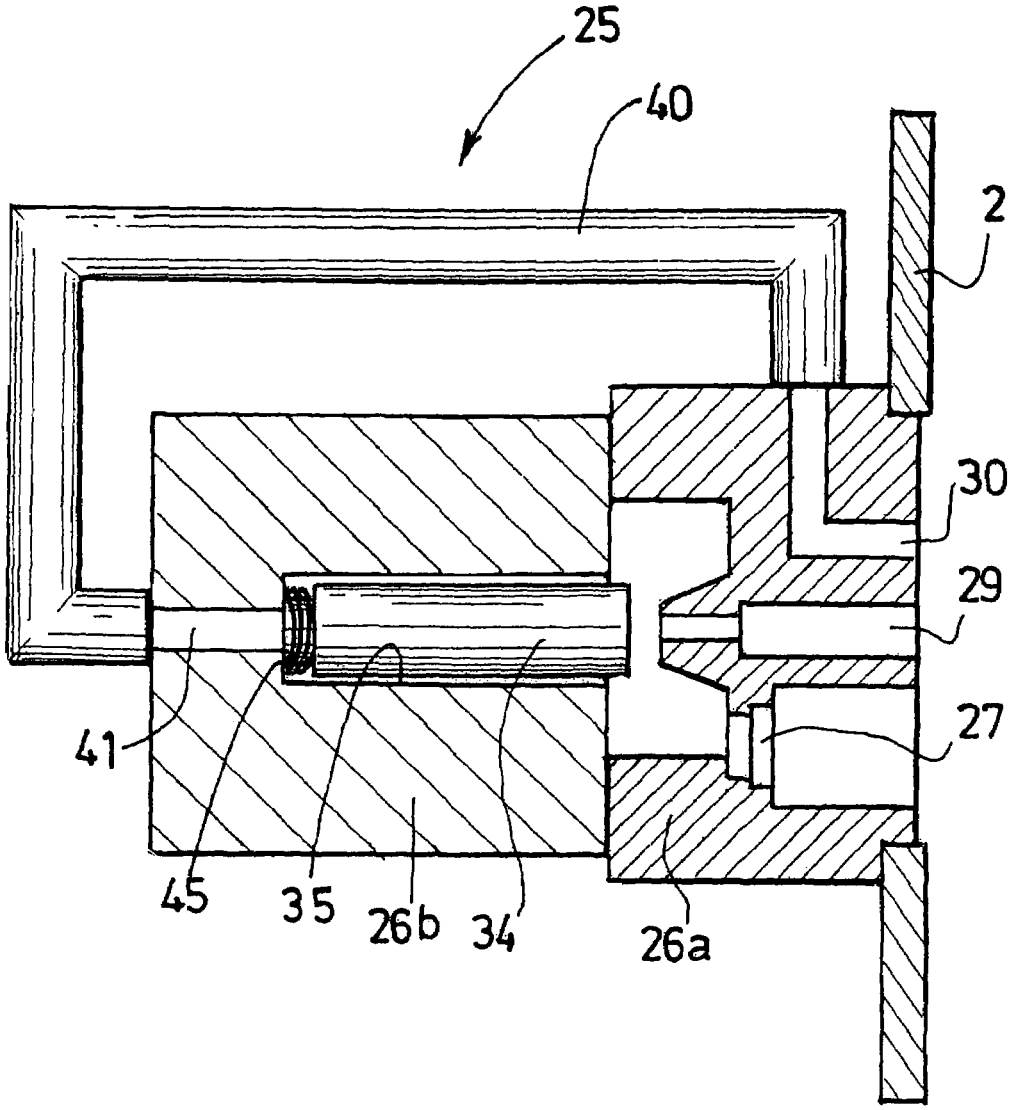

In another embodiment of the invention, shown in FIGS. 4 and 5, the solenoid valve 25 has a pipe 40 connecting the second outlet port 30 to a connection port 41 formed in the second body portion 26*b*. The connection port 41 leads into the bottom of the bore 35 containing the core 34 of the solenoid valve.

The connection port 41 leads to an annular chamber 42 formed inside the first body portion 26*a* via a passage running between the bore 35 and the core 34. The oil inlet port 27 and the first oil outlet port 29 connect with the annular chamber 42.

In this embodiment of the invention, the core 34 is movable between a first closed position in which the first oil outlet port 29 is closed and the connection port 41 is open, as shown in FIG. 4, and a second position in which the first oil outlet port 29 is open and the connection port 41 is closed, as shown in FIG. 5.

In the first position of the core 34 shown in FIG. 4, all the oil entering the solenoid valve through the oil inlet port 27 is directed towards the second oil outlet port 30 via the annular chamber 42, the connection port 41 and the pipe 40.

In the second position of the core 34 shown in FIG. 5, all of the oil entering the solenoid valve through the oil inlet port 27 is directed towards the first oil outlet port 29 and falls by gravity into the oil sump 22.

As in the embodiment described previously, the control means are designed to move the core 34 of the solenoid valve 25 to its first position when the speed of the compressor is below a predetermined threshold value, and move the core of the solenoid valve to its second position when the speed of the compressor is above this predetermined value.

Figure 6:
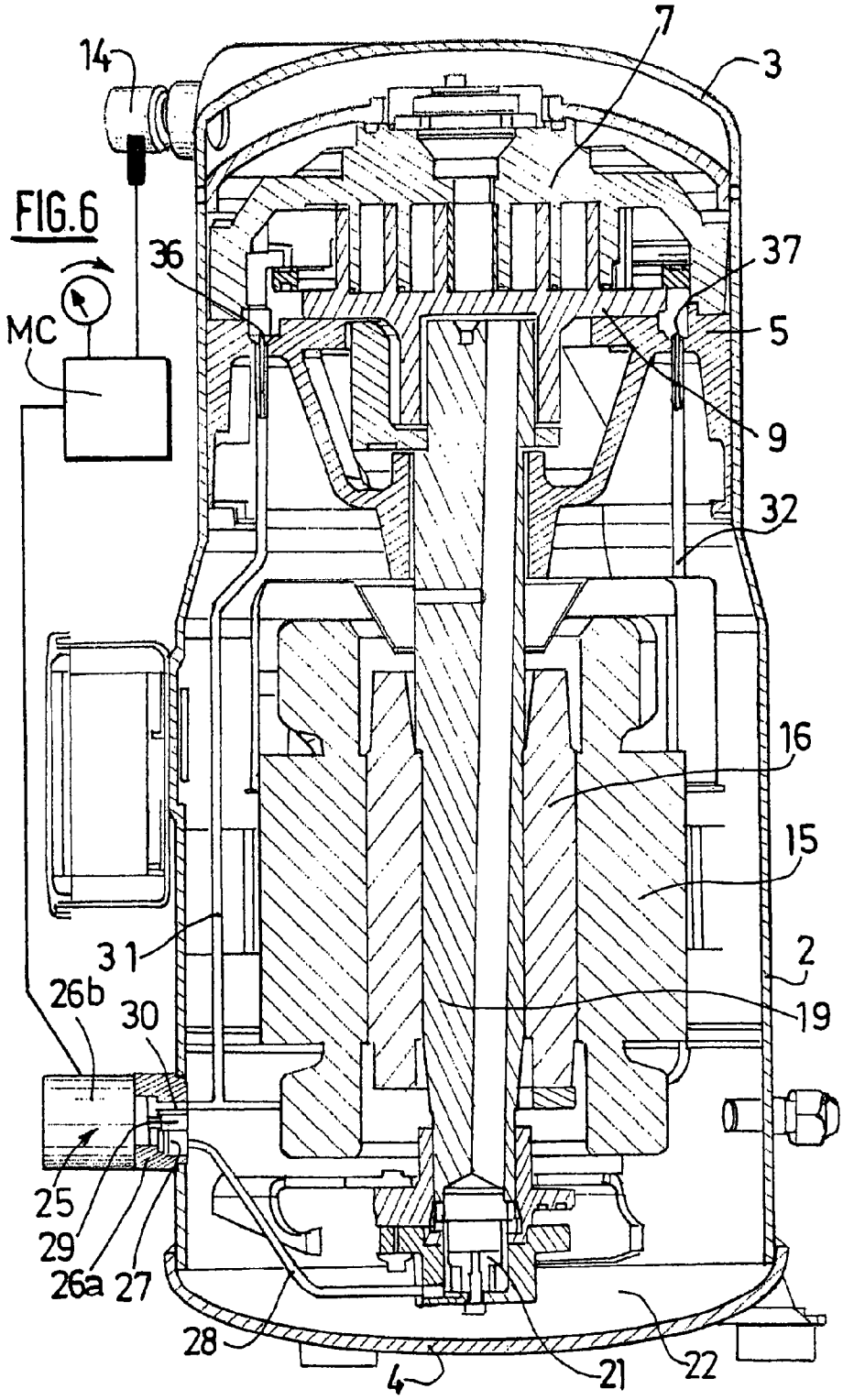
FIG. 6 is a longitudinal section through a second compressor.

FIG. 6 shows a second scroll compressor. The only difference between this and that shown in FIG. 1 is that the control means MC are designed to move the solenoid valve core 34 to its closed position when not only the delivery temperature of the refrigerant gas is above a predetermined value but also compressor speed is below a predetermined value, and to move the solenoid valve core to its open position when compressor speed is above a predetermined value. For this purpose the control means have a temperature sensor to measure the refrigerant gas delivery temperature at the connector 14.

In another embodiment, the control means MC are designed to move the solenoid valve core 34 to its closed position when the refrigerant gas delivery temperature is above a predetermined value, and to move the solenoid valve core to its open position when the refrigerant gas delivery temperature is below a predetermined value.

Figure 7:
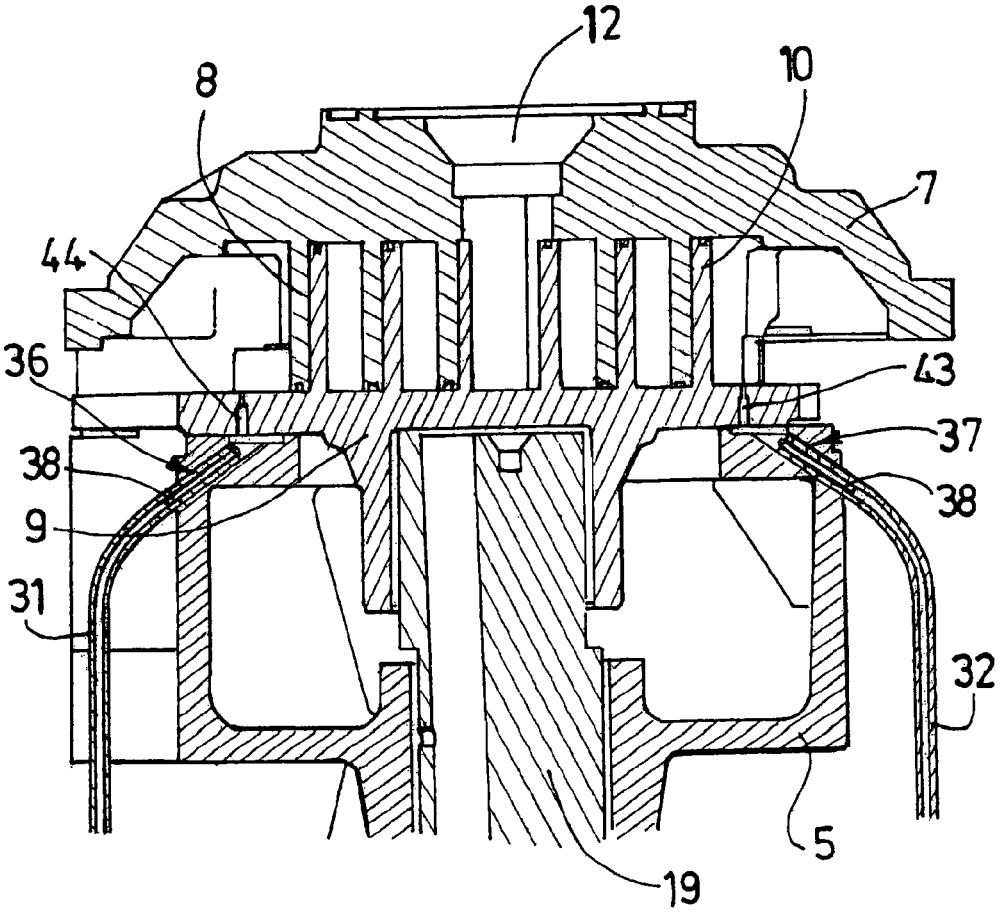
FIG. 7 is a partial longitudinal section through a third compressor.

FIG. 7 depicts a third scroll compressor. This differs from that shown in FIG. 1 in that the ends of the two bores 36, 37 directed at the moving volute 9 open within the area swept by the latter during its orbital movement, in that these two bores are not oriented parallel to the compressor axis but obliquely inwards relative to this axis, and in that the moving volute 9 comprises first and second through-ports 43, 44

The first and second through-ports 43, 44 are designed to connect together, during at least part of the movement of the moving volute, the ends of the first and second injection pipes 31, 32 directed towards the compression volume with a volume defined at least partly by the fixed 7 and moving 9 volutes.

It goes without saying that the invention is not limited to the embodiments described above by way of example of this scroll compressor. On the contrary, it encompasses all variants thereof. For instance, the bores 36, 37 could be oriented obliquely outward away from the compressor axis, or the number of injection pipes could be other than two.

The invention claimed is:

1. A variable-speed compressor comprising:

a sealed enclosure defining a suction volume and a compression volume, one on either side of a body contained within the enclosure, the enclosure comprising a refrigerant gas inlet, an oil injection line supplied with oil from oil contained in a sump in the bottom of the enclosure and designed to inject oil into the compression volume, the oil injection line comprising a solenoid valve having a core moveable, by a magnetic field, between a first position allowing oil to be injected into the compression volume and a second position preventing or limiting the injection of oil into the compression volume, and control means for moving the solenoid valve core between its first and second positions, wherein the solenoid valve has a body attached to a wall of the sealed enclosure and containing the core, and the control means are designed to move the solenoid valve core between its first and second positions, in response to at least one of a compressor speed or a refrigerant gas delivery temperature.

2. The variable-speed compressor as claimed in claim 1, wherein the body of the solenoid valve comprises a first body portion attached to the wall of the enclosure and a second body portion attached removably to the first body portion, outside of the sealed enclosure, the second body portion containing the solenoid valve core.

3. The variable-speed compressor as claimed in claim 1, wherein the control means are designed to move the solenoid valve core to its first position when the compressor speed is below a predetermined value or when the refrigerant gas delivery temperature is above a predetermined value.

4. The variable-speed compressor as claimed in claim 1, wherein the control means are designed to move the solenoid valve core to its first position when the refrigerant gas delivery temperature is above a predetermined value and the compressor speed is below a predetermined value.

5. The variable-speed compressor as claimed in claim 1, wherein the control means are designed to move the solenoid valve core to its second position when the compressor speed is above a predetermined value.

6. The variable-speed compressor as claimed in claim 1, further comprising an electric motor having a stator and, integral with a crankshaft-like drive shaft, a rotor, a first end of the drive shaft drives an oil pump supplying oil from the sump in the bottom of the enclosure to a way formed in a central part of the drive shaft, wherein the oil injection line is supplied with oil by the oil pump which is driven by the first end of the drive shaft.

7. The variable-speed compressor as claimed in claim 1, wherein the solenoid valve comprises at least one oil inlet port supplied with oil by a supply pipe located inside the sealed enclosure and connected to an outlet port of the oil pump which is driven by the first end of the drive shaft, a first oil outlet port opening inside the sealed enclosure, and a second oil outlet port connected to at least one injection pipe located inside the sealed enclosure and opening into the compression volume.

8. The variable-speed compressor as claimed in claim 7, wherein the solenoid valve core is movable, by a magnetic field, between a closed position of the first oil outlet port in which all the oil entering the solenoid valve through the oil inlet port is directed to the second oil outlet port, and an open position of the first oil outlet port in which all or nearly all the oil entering the solenoid valve through the oil inlet port is directed to the first oil outlet port.

9. The variable-speed compressor as claimed in claim 8, wherein the solenoid valve comprises a pipe connecting the second oil outlet port to a connection port formed in the solenoid valve and leading into a bore formed in the solenoid valve and containing the core of the solenoid valve, the bore being connected to a chamber which in turn is connected to the oil inlet port and the first oil outlet port, and the core is designed to close the connection port when it is in its open position.

10. The variable-speed compressor as claimed in claim 7, wherein the solenoid valve comprises an annular chamber connecting together the oil inlet and oil outlet ports of the solenoid valve.

11. The variable-speed compressor as claimed in claim 7, wherein head losses in the second oil outlet port and in the injection pipe are much greater than those in the first oil outlet port.

12. The variable-speed compressor as claimed in claim 7, wherein the injection pipe comprises an injection nozzle at an end of the injection pipe which opens into the compression volume.

13. The variable-speed compressor as claimed in claim 7, wherein an end of the injection pipe that opens into the compression volume is inserted into a through-bore formed inside the body separating the compression and suction volumes.

14. The variable-speed compressor as claimed in claim 13, wherein a pin is inserted in the end of the injection pipe that leads into the compression volume in such a way as to compress the injection pipe against walls of the through-bore formed inside the body.

15. The variable-speed compressor as claimed in claim 13, wherein the compression volume comprises a fixed volute fitted with a scroll engaged in a scroll of a moving volute driven with an orbital movement, the moving volute bearing against the body separating the compression and suction volumes.

16. The variable-speed compressor as claimed in claim 15, wherein an end of the through-bore formed in the body which is directed towards the moving volute opens outside of the area swept by the moving volute during its orbital movement.

17. The variable-speed compressor as claimed in claim 15, wherein an end of the through-bore formed in the body which is directed towards the moving volute opens within the area swept by the moving volute during its orbital movement.

18. The variable-speed compressor as claimed in claim 17, wherein the moving volute comprises at least one through-port designed to connect, during at least part of the movement of the moving volute, the end of the injection pipe that opens into the compression volume to a volume defined at least partly by the fixed and moving volutes.

* * * * *